US009893440B2

(12) United States Patent
Kim

(10) Patent No.: US 9,893,440 B2
(45) Date of Patent: Feb. 13, 2018

(54) VERTICAL TYPE CONNECTING TERMINAL FOR STORAGE BATTERY

(71) Applicant: CHANG HWAN PRECISION TERMINAL CO., LTD., Dangjin-gun (KR)

(72) Inventor: Hwan Chang Kim, Yongin-si (KR)

(73) Assignee: CHANG HWAN PRECISION TERMINAL CO., LTD., Dangjin-Gun (KR)

( * ) Notice: Subject to any disclaimer, the term of this patent is extended or adjusted under 35 U.S.C. 154(b) by 0 days.

(21) Appl. No.: 15/296,449

(22) Filed: Oct. 18, 2016

(65) Prior Publication Data

US 2017/0264031 A1 Sep. 14, 2017

(30) Foreign Application Priority Data

Mar. 8, 2016 (KR) ..... 10-2016-0027577

(51) Int. Cl.
*H01R 4/38* (2006.01)
*H01R 11/28* (2006.01)

(52) U.S. Cl.
CPC ..... *H01R 11/283* (2013.01); *H01R 11/281* (2013.01)

(58) Field of Classification Search
CPC .... H01R 11/281; H01R 11/283; H01R 11/285
(Continued)

(56) References Cited

U.S. PATENT DOCUMENTS 6,200,173 B1 * 3/2001 Frisby ..... H01R 11/283 439/762
6,561,855 B1 * 5/2003 Cret ..... H01R 11/283 439/762

(Continued)

FOREIGN PATENT DOCUMENTS

JP 2000-82455 3/2000
KR 10-0821591 B1 4/2008

(Continued)

*Primary Examiner* — Khiem Nguyen
(74) *Attorney, Agent, or Firm* — Harness, Dickey & Pierce, P.L.C.

(57) ABSTRACT

Disclosed is a vertical type connecting terminal for a storage battery, the vertical type connecting terminal including: a body unit 10 which includes an insertion portion 11 which is formed in a cylindrical shape having a cut-out at one side, an electric power outlet 12 which is formed opposite to the cut-out of the insertion portion 11, and a pair of elastic pieces 13 which extends in a radial direction from both ends of the cut-out of the insertion portion 11 and has therein arc-shaped portions 13', respectively; a fastening member 20 which includes a washer member 21 which has inside thereof arc-shaped grooves 21' into which the arc-shaped portions 13' of the elastic piece 13 are inserted such that the washer member 21 is coupled to an upper portion of the elastic piece 13 and adjusts an interval between the elastic pieces 13 while moving vertically, a T-shaped tightening bolt 22 which is positioned below the elastic piece 13 and has a body 22*a* to be inserted into a through hole 21*c* formed in the washer member 21, and an elongated head 22*b*, and a tightening nut 23 which is fastened to the tightening bolt 22 from an upper side of the washer member 21 and allows the washer member 21 to move vertically, in which the tightening bolt 22 has protruding portions 22*c* which are formed at both ends of the head 22*b* and each have an inner inclined surface 22' so that a thickness of the protruding portion 22*c*

(Continued)

decreases upward, the protruding portions 22*c* are disposed to transverse the elastic pieces 13 in a width direction of the elastic pieces 13, and outer inclined surfaces 21*a*, which correspond to the inner inclined surfaces 22' of the protruding portions 22*c*, are formed at both sides in a width direction of the washer member 21.

10 Claims, 4 Drawing Sheets

(58) Field of Classification Search
USPC ..... 439/765–771
See application file for complete search history.

(56) References Cited

U.S. PATENT DOCUMENTS 9,590,325 B2 3/2017 Tanigawa et al.
2014/0134895 A1* 5/2014 Kim ..... H01R 11/283 439/758
2015/0147921 A1* 5/2015 Noh ..... H01R 11/283 439/770
2015/0325935 A1* 11/2015 Shonts ..... H01R 11/289 439/762

FOREIGN PATENT DOCUMENTS

| | | | |
|---|---|---|---|
| KR | 10-0821595 | B1 | 4/2008 |
| KR | 20-0442760 | Y1 | 12/2008 |
| KR | 10-2009-0063007 | A | 6/2009 |
| KR | 10-2010-0137921 | A | 12/2010 |
| KR | 10-1188637 | B1 | 10/2012 |
| KR | 20-2013-0004483 | | 7/2013 |
| KR | 10-1366118 | | 2/2014 |
| KR | 10-1377048 | | 3/2014 |
| WO | WO-2014/129534 | A1 | 8/2014 |

* cited by examiner

VERTICAL TYPE CONNECTING TERMINAL FOR STORAGE BATTERY

CROSS-REFERENCE TO RELATED APPLICATION

This application claims the benefit and priority of Korean Patent Application No. 10-2016-0027577 filed Mar. 8, 2016. The entire disclosure of the above application is incorporated herein by reference.

FIELD

The present disclosure relates to a connecting terminal for a storage battery which is installed on a storage battery for an automobile and allows electric power to be supplied therethrough, and more particularly, to a vertical type connecting terminal for a storage battery, which is configured such that a tightening nut may be fastened from an upper side, and accordingly, a fastening operation may be carried out without interference with peripheral devices, and shapes of a tightening bolt and a washer member are optimized, thereby preventing deformation of a post terminal caused by excessive torque, and preventing a deterioration in tightening force caused by a washer slip.

BACKGROUND

This section provides background information related to the present disclosure which is not necessarily prior art.

In general, an automobile is driven by an engine, but it is necessary to supply electric current in order to activate a drive motor for starting the engine, and to operate various types of electrical components, and a storage battery is installed to supply electric current.

Further, to supply electric power from the storage battery, a connecting terminal, which connects a post terminal of the storage battery and a terminal of a power source, is installed on the storage battery. In this case, the connecting terminal is manufactured in various shapes in consideration of a layout according to the arrangement of the storage battery.

As illustrated in FIG. 1, a typical connecting terminal for a storage battery includes a fixing plate 120 which is formed in a plate shape and has a fastening hole formed at a center of the fixing plate 120 and having a predetermined size, a fixing member 130 which is vertically mounted to a fastening hole provided at a center of the fixing plate 120, an insertion portion 140 which is provided at one side of the fixing plate 120, and has a circular shape opened at one side thereof, such that a post terminal of a storage battery (not shown) is inserted into the insertion portion 140, and tightening portions 150 which are formed at one side of the insertion portion 140 so as to be symmetrical about the horizontal axis.

The tightening portions 150 have tightening holes at front and rear sides thereof, such that a diameter of the insertion portion 140 may be adjusted by the tightening bolt 151 and the tightening nut 152. In addition, in order to prevent the insertion portion 140 from being excessively deformed, a hollow fixing member may be provided to be interposed between the tightening bolt 151 and the tightening nut 152.

Further, the connecting terminal for a storage battery 100 in the related art may include a terminal 170 in which connection wires (not illustrated), which are connected in series or parallel and allow electric power of the storage battery to be supplied into the automobile, are installed, and a cover 160 for protecting the terminal 170 and the connection wires. The terminal 170 has at one side a fastening hole into which the fixing member 130 is inserted, and a fixing nut 131 is fastened to the fixing member 130 with a washer 132 interposed between the fixing nut 131 and the fixing member 130, such that the terminal 170 is installed on the fixing plate 120.

However, in the case of the connecting terminal for a storage battery in the related art, because the tightening bolt is positioned at a lateral side of the storage battery, there are problems in that operators suffer from the difficulty of performing the fastening operation, and it is difficult to perform the operation because of interference caused by other components in the automobile when tightening tools are used.

In order to solve the problems with interference, connecting terminals for a storage battery have been developed in which a tightening bolt is installed inclinedly or vertically so as to make it easy to perform the operation of fastening the tightening nut by using the tightening tools.

However, in the case of the existing connecting terminal for a storage battery, there are problems in that the post terminal of the storage battery may be deformed or damaged by excessive tightening torque, or tightening force may deteriorate because of a washer slip phenomenon, and force for holding the post terminal may deteriorate because of movement of the tightening bolt and the like.

Meanwhile, as a result of searching document of related art associated with the present disclosure, a number of patent document are retrieved, and some of the documents will be introduced below.

Patent KR10-0821595 B1 discloses a battery terminal coupler for an automobile, in which a part of the body having sufficient rigidity is cut out, and an inclined surface is formed on an outer surface of a joint portion connected with the part of the body, and the joint portion may be fastened by moving vertically a clamp having an inclined surface as an inner surface, such that the battery terminal coupler for an automobile is tightened by a clamp.

Patent KR10-2010-0137921 A discloses a terminal coupler for a vehicle battery using a tightening nut that a joint portion having a cut-out portion extending along a cut-out portion of a body having a post coupling hole is tightened by using an inclined protrusion having a conical shape and a tightening nut having a groove formed in a bottom surface thereof, such that high coupling strength is maintained, and a structure is simple.

Patent KR10-2009-0063007 A discloses a cable terminal for a vehicle battery, in which an upper plate and a lower plate are integrated so that the upper plate and the lower plate cannot be moved, and a shape and a dimension between cut-out portions of the upper plate and the lower plate, which are tightened between the cut-out portions, are uniformly maintained when a fastening bracket is moved downward, thereby generating uniform rotation coupling force.

SUMMARY

This section provides a general summary of the disclosure, and is not a comprehensive disclosure of its full scope or all of its features.

According to one aspect of the present disclosure, a vertical type connecting terminal for a storage battery includes: a body unit which includes an insertion portion which is formed in a cylindrical shape having a cut-out at one side and into which a post terminal of a storage battery is inserted, an electric power outlet which is formed opposite to the cut-out of the insertion portion, and a pair of elastic pieces which extends in a radial direction from both ends of the cut-out of the insertion portion and has inside thereof arc-shaped portions, respectively, in which the insertion portion, the electric power outlet, and the elastic pieces are integrally formed; and a fastening member which includes a washer member which has therein arc-shaped grooves into which the arc-shaped portions of the elastic piece are inserted such that the washer member is coupled to an upper portion of the elastic piece and adjusts an interval between the elastic pieces while moving vertically, a T-shaped tightening bolt which is positioned below the elastic piece and has a body to be inserted into a through hole formed in the washer member, and an elongated head, and a tightening nut which is fastened to the tightening bolt from an upper side of the washer member and allows the washer member to move vertically, in which a diameter of the insertion portion is changed by adjusting the interval between the elastic pieces, in which the tightening bolt has protruding portions which are formed at both ends of the head and each have an inner inclined surface so that a thickness of the protruding portion decreases upward, the protruding portions are disposed to transverse the elastic pieces in a width direction of the elastic pieces, and outer inclined surfaces, which correspond to the inner inclined surfaces of the protruding portions, are formed at both sides in a width direction of the washer member.

In addition, according to the vertical type connecting terminal for a storage battery according to the present disclosure, head grooves into which the head of the tightening bolt is inserted may be formed in bottom surfaces of the elastic pieces.

In addition, according to the vertical type connecting terminal for a storage battery according to the present disclosure, the protruding portions of the head may be inserted into grooves formed at both sides in the width direction of the washer member, and the outer inclined surfaces of the washer member may be formed as inner surfaces of the grooves.

In addition, according to the vertical type connecting terminal for a storage battery according to the present disclosure, inclined portions may be provided at outer sides of the elastic pieces, and the washer member may further have inner inclined surfaces which each have a width that increases downward so as to correspond to the inclined portion of the elastic piece accommodated in the washer member.

In addition, according to the vertical type connecting terminal for a storage battery according to the present disclosure, stoppers, which prevent the movement of the washer member, may be formed by bending ends of the elastic pieces outward.

In addition, according to the vertical type connecting terminal for a storage battery according to the present disclosure, the washer member may have raised portions formed on end surfaces directed toward the insertion portion, and inner surfaces of the raised portions may be formed as curved surfaces so as to come into surface-to-surface contact with an outer surface of the insertion portion, straight beads may protrude vertically from the outer surface of the insertion portion, and guide grooves, which are formed to be longer than the straight beads and into which the straight beads are inserted, may be provided in the washer member.

In addition, according to the vertical type connecting terminal for a storage battery according to the present disclosure, seating pieces, which are seated on an upper surface of a storage battery and have predetermined widths, may protrude from the outer surface at a lower end of the insertion portion.

In addition, according to the vertical type connecting terminal for a storage battery according to the present disclosure, the insertion portion may be formed to have a tapered structure having an inner diameter that increases downward.

In addition, according to the vertical type connecting terminal for a storage battery according to the present disclosure, the fastening member may further include a spring member which is inserted into the tightening bolt, and elastically supports the washer member.

In addition, according to the vertical type connecting terminal for a storage battery according to the present disclosure, the electric power outlet may have a structure in which a connecting bolt is fastened, a sensor having a shunt member is installed, or a sensor installation hole is formed.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Example embodiments will now be described more fully with reference to the accompanying drawings.

Figure 1:
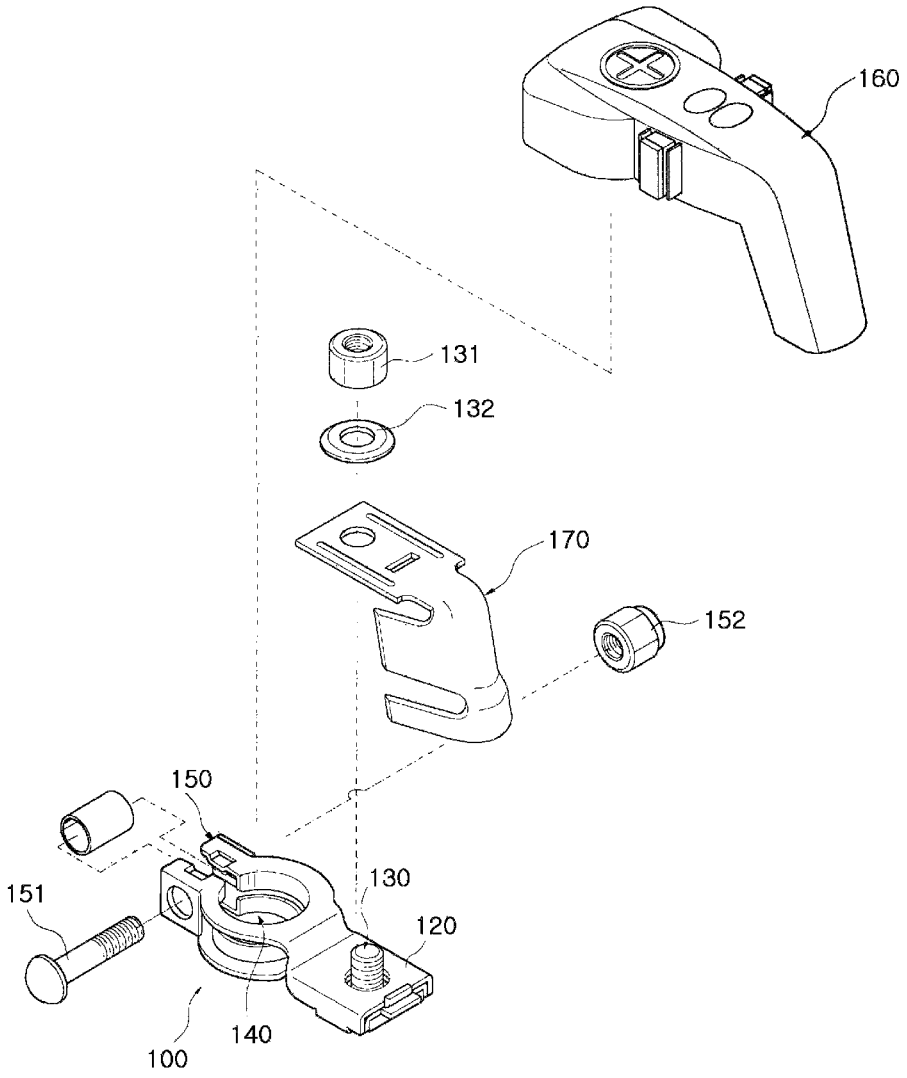
FIG. 1 is a configuration diagram illustrating a connecting terminal for a storage battery in the related art.
Figure 2:
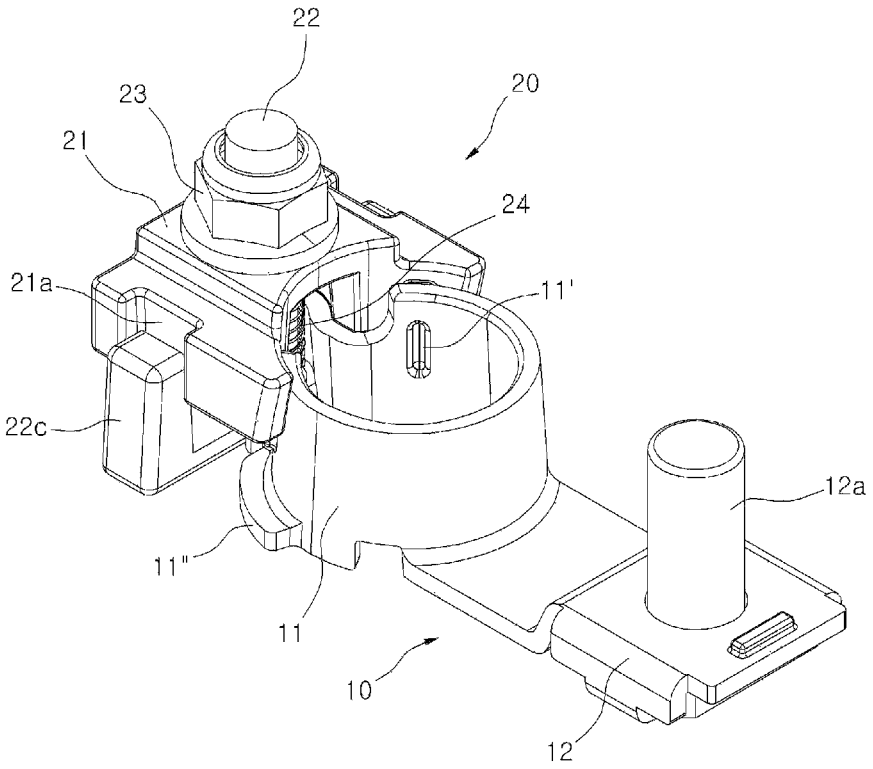
FIG. 2 is a perspective view illustrating a vertical type connecting terminal for a storage battery according to the present disclosure.
Figure 3:
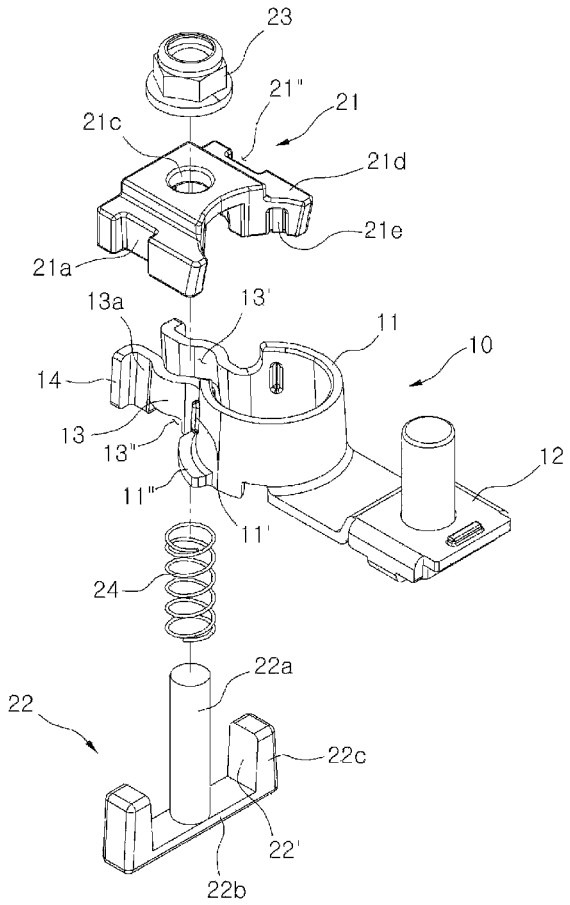
FIG. 3 is an exploded perspective view of the vertical type connecting terminal for a storage battery according to the present disclosure.
Figure 4:
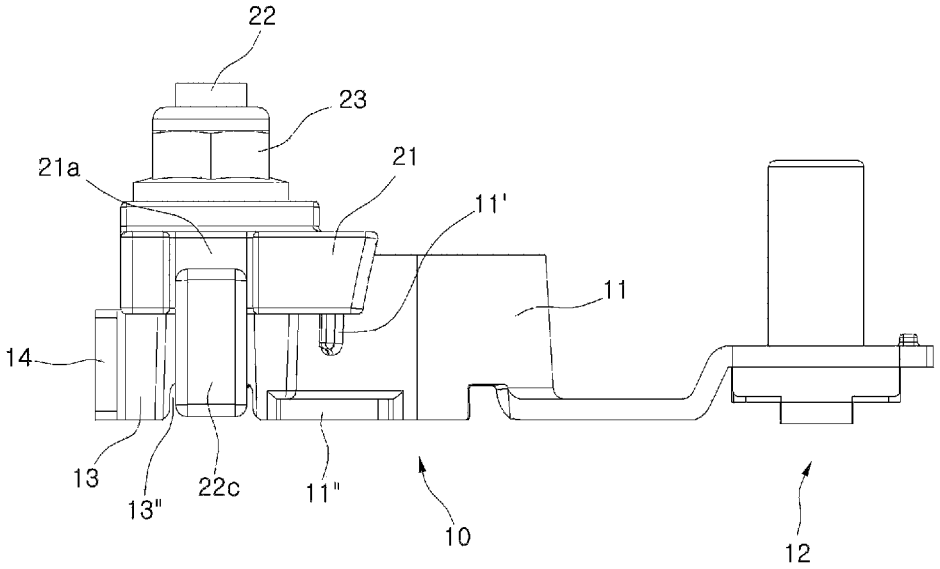
FIG. 4 is a front view of the vertical type connecting terminal for a storage battery according to the present disclosure.
Figure 5:
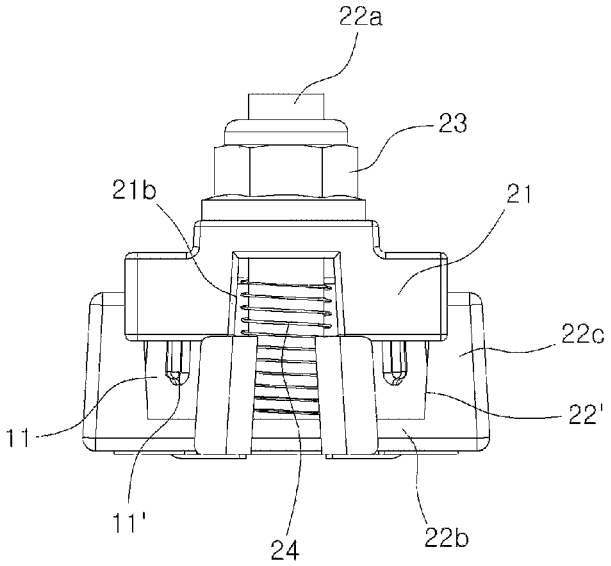
FIG. 5 is a left side view of the vertical type connecting terminal for a storage battery according to the present disclosure.
Figure 6:
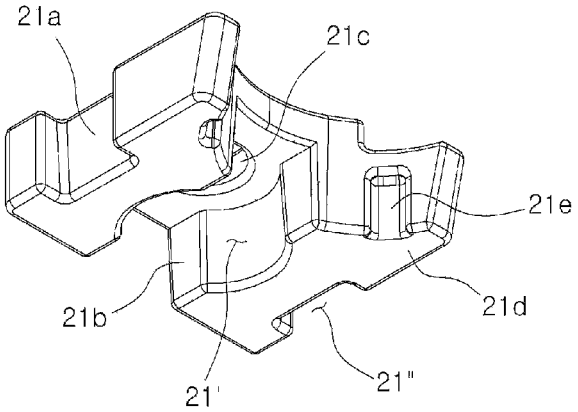
FIG. 6 is a bottom perspective view of a washer member which is a main part of the present disclosure.

As illustrated in FIGS. 2 to 6, the vertical type connecting terminal for a storage battery according to the present disclosure includes: a body unit 10 which includes an insertion portion 11 which is formed in a cylindrical shape having a cut-out at one side and into which a post terminal of a storage battery is inserted, an electric power outlet 12 which is formed opposite to the cut-out of the insertion portion 11, and a pair of elastic pieces 13 which extends in a radial direction from both ends of the cut-out of the insertion portion 11 and has therein arc-shaped portions 13', respectively, in which the insertion portion 11, the electric power outlet 12, and the elastic pieces 13 are integrally formed; and a fastening member 20 which includes a washer member 21 which has therein arc-shaped grooves 21' into which the arc-shaped portions 13' of the elastic piece 13 are inserted such that the washer member 21 is coupled to an upper portion of the elastic piece 13 and adjusts an interval between the elastic pieces 13 while moving vertically, a T-shaped tightening bolt 22 which is positioned below the elastic piece 13 and has a body 22*a* to be inserted into a through hole 21*c* formed in the washer member 21, and an elongated head 22*b*, and a tightening nut 23 which is fastened to the tightening bolt 22 from an upper side of the washer member 21 and allows the washer member 21 to move vertically, in which a diameter of the insertion portion 11 is changed by adjusting the interval between the elastic pieces 13.

Here, the tightening bolt 22 has protruding portions 22*c* which are formed at both ends of the head 22*b* and each have an inner inclined surface 22' so that a thickness of the protruding portion 22*c* decreases upward, the protruding portions 22*c* are disposed to transverse the elastic pieces 13 in a width direction of the elastic pieces 13, and outer inclined surfaces 21*a*, which correspond to the inner inclined surfaces 22' of the protruding portions 22*c*, are formed at both sides in a width direction of the washer member 21.

Therefore, when the tightening nut 23 is tightened in a state in which a position of the tightening bolt 22 is fixed, the washer member 21 is moved downward, and at the same time, inward pressing force is applied to the washer member 21 by the inclined contact between the inner inclined surfaces 22' of the tightening bolt 22 and the outer inclined surfaces 21*a* of the washer member 21. For this reason, diameters of the arc-shaped grooves 21' formed inside the washer member 21 are decreased, which tightens the arc-shaped portions 13' of the elastic pieces 13, and accordingly, the interval between the elastic pieces 13 decreases. Further, as the interval between the elastic pieces 13 decreases, an inner diameter of the insertion portion 11 decreases, thereby tightening the post terminal of the storage battery.

In this case, head grooves 13" into which the head 22*b* of the tightening bolt 22 is inserted may be formed in bottom surfaces of the elastic pieces 13, and more particularly, the protruding portions 22*c* of the tightening bolt 22 may be inserted into grooves 21" formed at both sides in the width direction of the washer member 21, and the outer inclined surfaces 21*a* of the washer member 21 may be formed as inner surfaces of the grooves 21".

The head grooves 13" prevent the tightening bolt 22 from moving in a longitudinal direction of the elastic pieces 13 while the tightening nut 23 is tightened, thereby preventing a washer slip phenomenon in which the washer member 21, which is moved downward by the tightening nut 23, moves in the longitudinal direction of the elastic pieces 13 together with the tightening bolt 22. In addition, the grooves 21" formed in the washer member 21 prevent the washer member 21 from moving in the longitudinal direction of the elastic pieces 13 while the washer member 21 moves upward and downward in a state in which the tightening bolt 22 is fixed, thereby preventing the washer slip phenomenon, and allowing the washer member 21 to smoothly move relative to the tightening bolt 22.

Further, inclined portions 13*a* are provided at outer sides of the elastic pieces 13, and the washer member 21 may further have inner inclined surfaces 21*b* which each have a width that increases downward so as to correspond to the inclined portion 13*a* of the elastic piece 13 accommodated in the washer member 21. The inclined portions 13' of the elastic pieces 13 and the inner inclined surfaces 21*b* of the washer member 21 are in inclined contact with each other, and accordingly, the vertical movement of the washer member 21 adjusts the interval between the elastic pieces 13, and a tightening function, which occurs by the inclined contact between the outer inclined surfaces 21*a* of the washer member 21 and the inner inclined surfaces 22' of the tightening bolt 22, is improved.

In addition, stoppers 14, which prevent the movement of the washer member 21, may be formed by bending ends of the elastic pieces 13 outward. The stoppers 14 prevent the washer slip phenomenon in which the washer member 21 moves in the longitudinal direction of the elastic pieces 13, and maximally inhibit the movement of components, which is caused by manufacturing tolerance of the components, during the operation of tightening the tightening nut 23.

Further, the washer member 21 has raised portions 21*d* formed at ends directed toward the insertion portion, and inner surfaces of the raised portions 21*d* are formed as curved surfaces so as to come into surface-to-surface contact with an outer surface of the insertion portion 11, and to surround a part of the insertion portion 11. The raised portions 21*d* are formed to surround approximately ⅓ of the insertion portion 11. In addition, straight beads 11' may protrude vertically from the outer surface of the insertion portion 11, and guide grooves 21*e*, which are formed to be longer than the straight beads 11' and into which the straight beads 11' are inserted, may be formed in surfaces of the washer member 21 which correspond to the straight beads 11'. In this case, the straight beads 11' and the guide grooves 21*e* may be formed at positions, respectively, which are symmetrical about the cut-out of the insertion portion 11.

Therefore, eccentric deformation does not occur and holding force is improved when the washer member 21 is moved downward and the diameter of the insertion portion 11 decreases, and the washer member 21 is moved downward without movement and slip when the washer member 21 is moved downward in a state in which the straight beads 11' of the insertion portion 11 are inserted into the guide grooves 21*e* of the washer member 21.

The structures, such as the head grooves 13" provided in the elastic pieces 13, the head 22*b* of the tightening bolt 22 which is inserted into the head grooves 13", the grooves 21" of the washer member 21, the protruding portions 22*c* of the tightening bolt 22 which are inserted into the grooves 21", the stoppers 14 provided on the elastic pieces 13, the guide grooves 21*e* of the washer member 21, and the straight beads 11' of the insertion portion 11 which are inserted into the guide grooves 21*e*, constitute a quadruple safety mechanism for preventing deformation of a terminal caused by excessive torque and a deterioration caused by a washer slip which were the problems in the related art, and serve to assuredly improve and maximize tightening force compared to the existing product.

Further, seating pieces 11", which are seated on an upper surface of the storage battery and have predetermined widths, may protrude from the outer surface at a lower end of the insertion portion 11. The seating pieces 11" reinforce strength of a lower end portion of the insertion portion 11 which comes into contact with the upper surface of the storage battery, and serve to improve restoring force of the insertion portion 11, and increase yield strength of the insertion portion 11 when excessive torque is applied, thereby preventing deformation of the post terminal of the storage battery as well as deformation of the insertion portion 11.

In addition, the insertion portion 11 is formed to have a tapered structure having an inner diameter that increases downward, and particularly, the inner diameter is formed as a 1/9 tapered structure. Here, the 1/9 tapered structure means a tapered structure in which a ratio between a radius and a height is 1:9, and specifically, the 1/9 tapered structure means that a radius at 9 mm below an uppermost end of the insertion portion 11 is greater by 1 mm than a radius at the uppermost end.

Further, the inner inclined surfaces 22' of the protruding portions 22*c*, the outer inclined surfaces 21*a* of the washer member 21, the outer surface inclined portions 13" of the elastic pieces 13, and the inner inclined surfaces 21*b* of the washer member 21 may have a 1/9 inclined structure. Here, because the 1/9 inclined structure means the same structure as the 1/9 tapered structure, a specific description thereof will be omitted. The reason why the 1/9 tapered structure and the 1/9 inclined structure are adapted to the inclined parts is to allow all of the parts to operate and move at the same angle when the washer member 21 is moved upward and downward by the tightening nut 23.

However, the arc-shaped portions 13' of the elastic pieces 13 and the arc-shaped grooves 21' of the washer member 21 which correspond to the arc-shaped portions 13' may have a structure different from the 1/9 tapered structure. The reason is to improve tightening force by the tightening nut 23, and since the arc-shaped portions 13' of the elastic pieces 13 and the arc-shaped grooves 21' of the washer member 21 has an angle different from an angle of other parts, overall tightening force is maximized.

Meanwhile, the fastening member 20 may further include a spring member 24 which is inserted into the body 22*a* of the tightening bolt 22, and elastically supports the washer member 21. The spring member 24 serves to allow the washer member 21 to be naturally moved upward by spring force when the tightening nut 23 is released. Therefore, even in a case in which the post terminal of the storage battery is deformed by excessive torque as well as in a case in which the tightening nut 23 is repeatedly fastened by being tightened and released, the washer member 21 may be moved upward by spring force. In particular, the spring member 24 prevents the washer member 21 from being trapped and fixed by the post terminal of the storage battery by excessive torque, thereby allowing the washer member 21 to be easily coupled to and separated from the post terminal of the storage battery.

Here, the electric power outlet 12 may be configured in various shapes, that is, the electric power outlet 12 may have a structure in which a connecting bolt 12*a* is fastened like a typical connecting terminal as illustrated in FIGS. 2 to 6, a resistance sensor having a shunt member may be installed, or the electric power outlet 12 may have a structure in which a sensor installation hole is formed.

The vertical type connecting terminal for a storage battery according to the present disclosure, which is configured as described above, maximizes tightening force by using the tapered structures of the inner inclined surfaces of the T-bolt-shaped tightening bolt, the outer inclined surfaces of the washer member, the inclined portions of the elastic pieces, the inner inclined surfaces of the washer member, the arc-shaped portions of the elastic pieces, and the arc-shaped grooves of the washer member, and the tapered structures of the end surfaces of the elastic piece, which are directed toward the insertion portion, and the insertion portion, and the vertical type connecting terminal for a storage battery according to the present disclosure prevents the tightening bolt and the insertion portion from moving in the longitudinal direction of the elastic pieces, by using the head grooves of the elastic pieces into which the head of the tightening bolt is inserted, the grooves of the washer member into which the protruding portions of the tightening bolt are inserted, the guide grooves of the washer member into which the straight beads of the insertion portion are inserted, and the stoppers formed at the outer ends of the elastic pieces, thereby preventing deformation caused by excessive torque or a deterioration in tightening force caused by a washer slip, and assuredly improving and maximizing tightening force compared to the existing product.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

DESCRIPTION OF MAIN REFERENCE NUMERALS OF DRAWINGS

10: Body unit
11: Insertion portion
11': Straight bead
11": Seating piece
12: Electric power outlet
12*a*: Connecting bolt
13: Elastic piece
13': Arc-shaped portion
13": Head groove
13*a*: Inclined portion
14: Stopper
20: Fastening member
21: Washer member
21': Arc-shaped groove
21": Groove
21*a*: Outer inclined surface
21*b*: Inner inclined surface
21*c*: Through hole
21*d*: Raised portion
21*e*: Guide groove
22: Tightening bolt
22*a*: Body
22*b*: Head
22*c*: Protruding portion
22': Inner inclined surface
23: Tightening nut
24: Spring member

The invention claimed is:

1. A vertical type connecting terminal for a storage battery, the vertical type connecting terminal comprising:

a body unit which includes an insertion portion which is formed in a cylindrical shape having a cut-out at one side and into which a post terminal of a storage battery is inserted, an electric power outlet which is formed opposite to the cut-out of the insertion portion, and a pair of elastic pieces which extends in a radial direction from both ends of the cut-out of the insertion portion and has therein arc-shaped portions, respectively, in which the insertion portion, the electric power outlet, and the elastic pieces are integrally formed; and a fastening member which includes a washer member which has inside thereof arc-shaped grooves into which the arc-shaped portions of the elastic piece are inserted such that the washer member is coupled to an upper portion of the elastic piece and adjusts an interval between the elastic pieces while moving vertically, a T-shaped tightening bolt which is positioned below the elastic piece and has a body to be inserted into a through hole formed in the washer member, and an elongated head, and a tightening nut which is fastened to the tightening bolt from an upper side of the washer member and allows the washer member to move vertically, in which a diameter of the insertion portion is changed by adjusting the interval between the elastic pieces, wherein the tightening bolt has protruding portions which are formed at both ends of the head and each have an inner inclined surface so that a thickness of the protruding portion decreases upward, the protruding portions are disposed to transverse the elastic pieces in a width direction of the elastic pieces, and outer inclined surfaces, which correspond to the inner inclined surfaces of the protruding portions, are formed at both sides in a width direction of the washer member.

2. The vertical type connecting terminal of claim 1, wherein head grooves into which the head of the tightening bolt is inserted are formed in bottom surfaces of the elastic pieces.

3. The vertical type connecting terminal of claim 1, wherein the protruding portions of the tightening bolt are inserted into grooves formed at both sides in the width direction of the washer member, and the outer inclined surfaces of the washer member are formed as inner surfaces of the grooves.

4. The vertical type connecting terminal of claim 1, wherein inclined portions are provided at outer sides of the elastic pieces, and the washer member further has inner inclined surfaces which each have a width that increases downward so as to correspond to the inclined portion of the elastic piece accommodated in the washer member.

5. The vertical type connecting terminal of claim 1, wherein stoppers, which prevent the movement of the washer member, are formed by bending ends of the elastic pieces outward.

6. The vertical type connecting terminal of claim 1, wherein the washer member has raised portions formed on end surfaces directed toward the insertion portion, and inner surfaces of the raised portions are formed as curved surfaces so as to come into surface-to-surface contact with an outer surface of the insertion portion, straight beads protrude vertically from the outer surface of the insertion portion, and guide grooves, which are formed to be longer than the straight beads and into which the straight beads are inserted, are provided in the washer member.

7. The vertical type connecting terminal of claim 1, wherein seating pieces, which are seated on an upper surface of a storage battery and have predetermined widths, protrude from the outer surface at a lower end of the insertion portion.

8. The vertical type connecting terminal of claim 1, wherein the insertion portion is formed to have a tapered structure having an inner diameter that increases downward.

9. The vertical type connecting terminal of claim 1, wherein the fastening member further includes a spring member which is inserted into the tightening bolt, and elastically supports the washer member.

10. The vertical type connecting terminal of claim 1, wherein the electric power outlet has a structure in which a connecting bolt is fastened, a sensor having a shunt member is installed, or a sensor installation hole is formed.

* * * * *